US005204660A

United States Patent [19]

Kamagami et al.

[11] Patent Number: 5,204,660

[45] Date of Patent: Apr. 20, 1993

[54] METHOD AND APPARATUS FOR DRIVING LIQUID CRYSTAL DISPLAY DEVICE

[75] Inventors: Shinichi Kamagami, Yokohama; Hiroshi Morita, Kawasaki, both of Japan

[73] Assignee: Kabushiki Kaisha Toshiba, Kawasaki, Japan

[21] Appl. No.: 771,509

[22] Filed: Oct. 4, 1991

[30] Foreign Application Priority Data

Oct. 5, 1990 [JP] Japan ..... 2-266253

[51] Int. Cl.[5] ..... G09G 3/36

[52] U.S. Cl. ..... 340/784; 340/805; 359/57

[58] Field of Search ..... 340/784, 784 C, 784 D, 340/765, 805; 359/55, 57; 358/241

[56] References Cited

U.S. PATENT DOCUMENTS 4,236,155 11/1980 Nagata ..... 340/805
4,413,883 11/1983 Baraff et al. ..... 359/58
4,794,385 12/1988 Kuijk ..... 340/784
4,978,951 12/1990 Knapp ..... 340/784

OTHER PUBLICATIONS

T. J. Scheffer,: SID Seminar Lecture Note, p. 7.1. (1986) Direct-multiplexed liquid-crystal displays.
W. E. Howard,: SID Seminar Lecture Note, p. 7.2 (1986) Active-matrix techniques for displays.

*Primary Examiner*—Ulysses Weldon
*Assistant Examiner*—Doon Yue Chow
*Attorney, Agent, or Firm*—Cushman, Darby & Cushman

[57] ABSTRACT

In a liquid crystal display device, MIM type nonlinear resistive swiching elements are connected to pixel electroes, respectively, counter electrodes are arranged to oppose the pixel electrodes and, a liquid crystal layer having a threshould voltage Vth (V) and a saturation voltage Vsat (V) is arranged between the pixel electrodes and the counter electrodes. A voltage having a voltage waveform constituted by a select period in which the signal voltage is applied and a nonselect period in which the signal voltage is held is generated between said electrodes, and an absolute value Vb (V) of the voltage applied between said electrodes during the nonselect period satisfies a relation of:

$$V'/2-0.4 \leqq Vb \leqq V'/2+0.5$$

(where $V'=Vth+Vsat$).

8 Claims, 7 Drawing Sheets

METHOD AND APPARATUS FOR DRIVING LIQUID CRYSTAL DISPLAY DEVICE

BACKGROUND OF THE INVENTION

1. Field of the Invention

The present invention relates to a method and an apparatus for driving a liquid crystal display device and, more particularly, to a method and an apparatus for driving a liquid crystal display device which incorporates switching elements each having a nonlinear current-voltage characteristic in a one-to-one correspondence with pixels.

2. Description of the Related Art

Recently, a liquid crystal display device is used not only as a comparatively simple display device incorporated in, e.g., a timepiece, a portable calculator, or a measuring instrument, but also as a display device for displaying large-capacity information, e.g., a display device incorporated in a personal computer, a word-processor, an OA terminal station, or a TV image display. In such a large-capacity liquid crystal display device, a method of time-divisionally driving display elements, i.e., pixels arranged in a matrix manner is generally adopted. In this method, however, no sufficient contrast ratio can be obtained between a display portion constituted by pixels to be turned on and a non-display portion constituted by pixels to be turned off, due to essential properties of a liquid crystal itself. That is, the contrast ratio is degraded as scanning electrodes are increased and it is practically limited that the display device have about 200 scanning electrodes. The contrast ratio is significantly reduced in a large-scale matrix display device having 500 or more scanning electrodes. This reduction in contrast ratio is a fatal defect for a display device.

Systems for solving this problem of the liquid crystal display device have been widely developed in many places. In one system, individual pixels are directly switched, and a thin-film transistor is adopted as a switching element. Although various types of materials such as cadmium selenide and tellurium have been conventionally proposed as a semiconductor for forming this thin-film transistor, amorphous silicon is most widely studied recently. In the manufacture of a liquid crystal display device of this type, however, since a step of micropatterning must be performed a plurality of times, the manufacturing steps are complicated to lead to a poor yield. As a result, the product cost is increased, and it is very difficult to manufacture a large-scale liquid crystal display device.

As another system using a switching element array, a liquid crystal display device using switching elements (to be referred to as nonlinear resistive elements hereinafter) each having a nonlinear current-voltage characteristic is available. This nonlinear resistive element basically has two terminals whereas the number of terminals of the thin-film transistor is three. Therefore, the nonlinear resistive element has a simpler structure and can be easily manufactured. For this reason, since an improvement in product yield can be expected, the cost can be advantageously reduced.

As the nonlinear resistive element, a junction diode type using a material similar to that of the thin-film transistor, a varistor type using zinc oxide, a metal-insulator-metal (MIM) type in which an insulator is sandwiched between electrodes, and a metalx semi-insulator (MSI) type in which a semi-insulator layer is sandwiched between metal electrodes have already been developed. Of these types, the MIM type is one of those having the simplest structure and has already been put into practical use presently.

FIG. 1 shows a voltage waveform applied to a liquid crystal layer of the MIM type liquid crystal display device, in which the ordinate represents a voltage VLC applied to the liquid crystal layer and the abscissa represents time. In this MIM liquid crystal display device, when a drive voltage is applied to each pixel, the liquid crystal is charged at a small time constant. When application of the drive voltage is stopped, the liquid crystal is discharged at a large time constant. Therefore, as shown in FIG. 1, the liquid crystal is charged within a short select period ron from the ON timing of the drive voltage, and a sufficient voltage is held between the electrodes sandwiching a liquid crystal for a long period $\tau$off even after the drive voltage is cut off. As a result, the application voltage during the select period $\tau$on determines an effective value of the drive voltage. In the MIM type liquid crystal display device, therefore, an effective value ratio of an effective drive voltage during a period in which liquid crystal display elements transmit light with respect to that during a period in which these elements shut light can be increased to be higher than that obtained when a conventional matrix type display device is time-divisionally driven. Therefore, a liquid crystal display device which does not reduce the contrast ratio is realized.

In the MIM type liquid crystal display device as described above, since a current-voltage characteristic of each MIM element is not symmetrical in the positive and negative directions, a display screen flickers. In addition, when one display pattern is displayed over a long time period, the display pattern slightly remains for a while, i.e., an afterimage phenomenon occurs. The flicker can be suppressed by superposing a DC offset voltage on a drive waveform. The afterimage phenomenon, however, occurs even when the DC offset voltage is applied to suppress the flicker. When the ON/OFF effective value ratio is sufficiently high, i.e., when a liquid crystal display device having about 100 to about 300 scanning electrodes is time-divisionally driven, the afterimage phenomenon is so subtle as to be apparently negligible. However, when the ON/OFF effective value ratio is inevitably reduced, e.g., when a liquid crystal display device having about 300 to about 1,000 scanning electrodes is time-divisionally driven, the afterimage phenomenon is apparently enhanced. This afterimage phenomenon is a serious problem in practical applications because it significantly deteriorates display quality.

SUMMARY OF THE INVENTION

It is an object of the present invention to provide a liquid crystal display device having a high quality display free from an afterimage phenomenon and the like even when the number of scanning electrodes of the device is increased.

According to the present invention, there is provided a method of driving a liquid crystal display device, wherein a liquid crystal display device comprising switching elements each having a nonlinear current-voltage characteristic which is asymmetrical between positive and negative directions of voltage application, a plurality of pixels each incorporating the switching element, and a liquid crystal having a threshold voltage Vth (V) and a saturation voltage Vsat (V) as electrooptical characteristics is time-divisionally driven by a voltage waveform constituted by a select period in which a signal voltage is written in predetermined pixels and a nonselect period in which the written signal voltage is held. This liquid crystal display device is time-divisionally driven by a voltage waveform set such that an absolute value Vb (V) of the voltage applied to the pixels during the nonselect period satisfies a relation of:

$$V'/2-0.4 \leqq Vb \leqq V'/2+0.5$$

(where $V'=Vth+Vsat$).

In an example of the liquid crystal display device of normally white type, the threshould voltage Vth corresponds to a voltage applied to the liquid crystal which permits light rays therethrough at a transmission coefficient of 90% and the saturation voltage Vsat corresponds to a voltage applied to the liquid crystal which permits light rays therethrough at a transmission coefficient of 10%.

In a two-terminal liquid crystal display device such as the MIM type device, since a current-voltage characteristic of each MIM element is not symmetrical in the positive and negative directions, a DC voltage or the like is generated to cause an afterimage phenomenon. Therefore, it is assumed that no afterimage phenomenon occurs if the current-voltage characteristic of the MIM element is symmetrical. However, it is not easy to symmetrize the current-voltage characteristic of the MIM element, i.e., it is not easy to form two metal-insulator junction interfaces so as to have the same characteristics and to symmetrize the film quality of the insulator in the direction of film thickness.

Under these circumstances, the present inventors have conducted various experiments and obtained the following finding as a key to a solution to the problem. That is, assuming that the amount of an afterimage phenomenon is represented by a difference $\Delta Tr$ between a transmittance obtained when an ON state in which the transmittance is 50% is continuously set after it is continued for a predetermined time period $\tau$ and that obtained when the ON state is set after an OFF state is continued for the predetermined time period $\tau$, the size $\Delta Tr$ of the afterimage phenomenon depends on an absolute value Vb of a voltage applied to the pixels during a nonselect period. The present inventors have checked various types of liquid crystals having different threshold voltages Vth and different saturation voltages Vsat and found that an absolute value Vb of the voltage is not determined by the ratio with respect to the voltage applied during the select period but need only fall within the range of:

$$V'/2-0.4 \leqq Vb \leqq V'/2+0.5$$

where $V'=Vth+Vsat$.

This range of the absolute value Vb of the voltage is largely different from an optimal bias ratio used in a super twisted nematic (STN) liquid crystal display device. (The optimal bias ratio is $1\sqrt{N+1}$) at a duty ratio of 1/N.)

As shown in FIG. 2, since the current-voltage characteristic of the MIM element is asymmetrical, a DC voltage is generated. It is assumed that this DC voltage forms a charge double layer in the interface with respect to the liquid crystal layer to cause an afterimage phenomenon. If an application voltage is low, the resistance of the MIM element is high. Therefore, generation of the DC voltage can be suppressed although the degree of asymmetry in the current-voltage characteristic is large. If the application voltage is high, generation of the DC voltage can be suppressed because the degree of asymmetry in the current-voltage characteristic is small. Therefore, as shown in FIG. 3, the DC voltage is assumed to be maximized at a certain application voltage.

The generated DC voltage changes between the ON and OFF states in accordance with the voltage applied during the select period. The difference between the DC voltages is minimized at a certain voltage. In a liquid crystal display device, a drive voltage is uniquely determined by a display contrast, and the difference between the DC voltages generated in the ON and OFF states can be minimized by changing a bias voltage within a range of the driving voltage. In addition, a voltage applied to a liquid crystal layer is constantly at about the saturation voltage Vsat in the ON state and about the threshold voltage Vth in the OFF state. Therefore, it is assumed that an optimal bias voltage is determined depending on the electrooptical characteristics of a liquid crystal itself.

In the liquid crystal display device of the present invention, the absolute value of a voltage applied to pixels during the nonselect period is set to satisfy a relation of:

$$V'/2-0.4 \leqq Vb \leqq V'/2+0.5$$

so that the difference between the DC voltages generated in the ON and OFF states is minimized. Therefore, since the device is driven in an optimal state in which the afterimage phenomenon is negligible, a high-quality display can be constantly provided.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

A liquid crystal display device of the present invention will be described in detail below with reference to the accompanying drawings.

Figure 1:
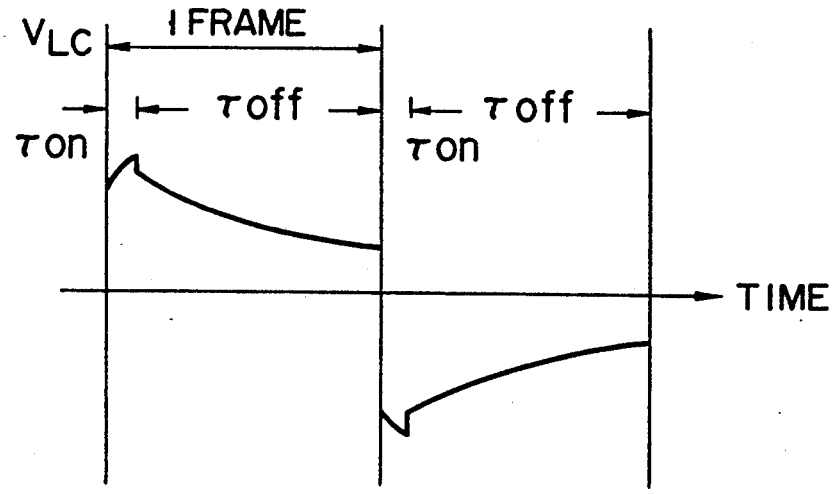
FIG. 1 (PRIOR ART)
FIG. 1 is a timing chart showing the waveform of a voltage applied to a liquid crystal layer of a liquid crystal display device incorporating a nonlinear resistive element in each pixel.
Figure 2:
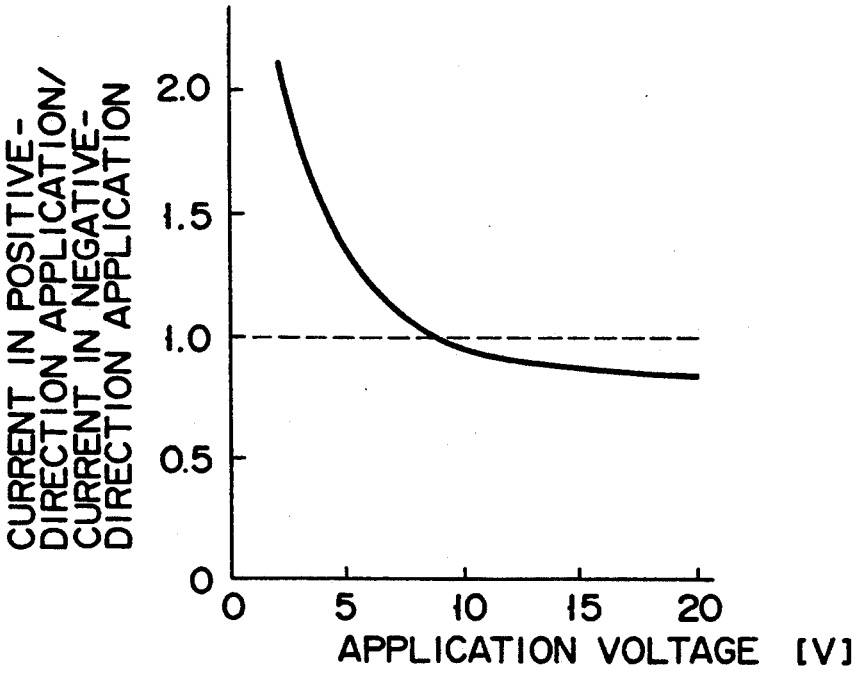
FIG. 2 is a graph showing a current ratio obtained when a voltage application direction of an MIM element is a positive/negative direction.
Figure 3:
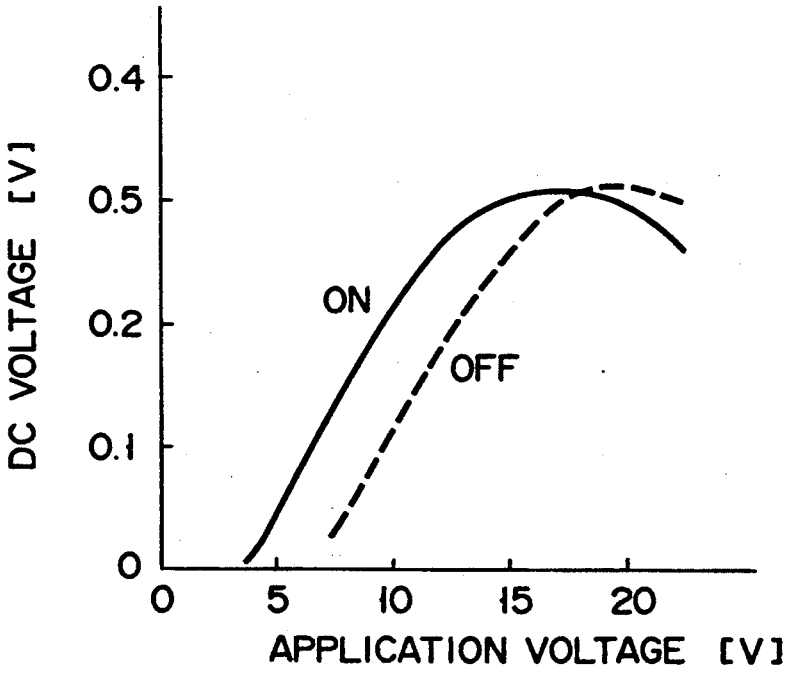
FIG. 3 is a graph showing an application voltage dependency of a generated DC voltage.
Figure 4:
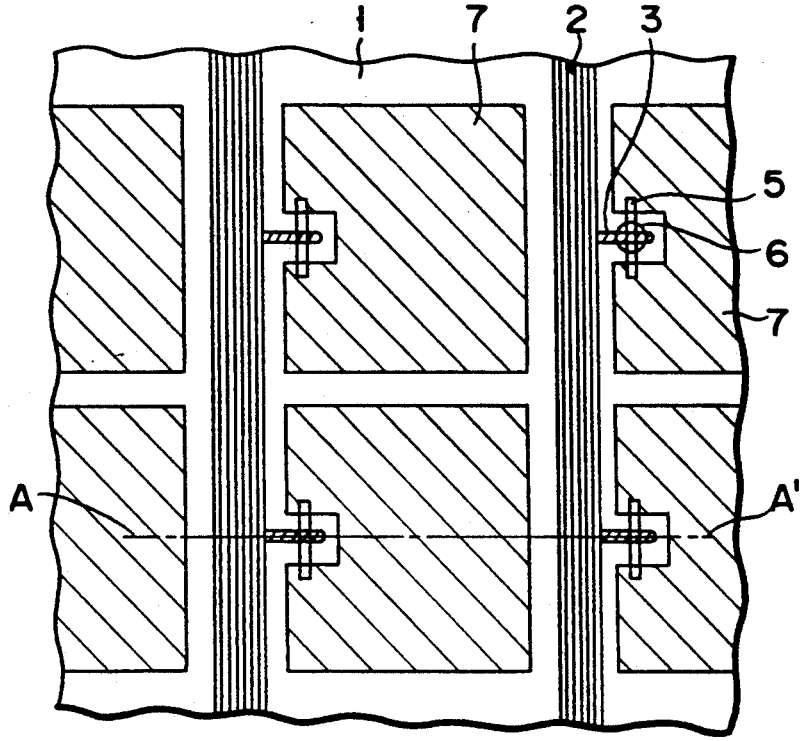
FIGS. 4 and 5 are views showing a liquid crystal display device according to an embodiment of the present invention.
Figure 5:
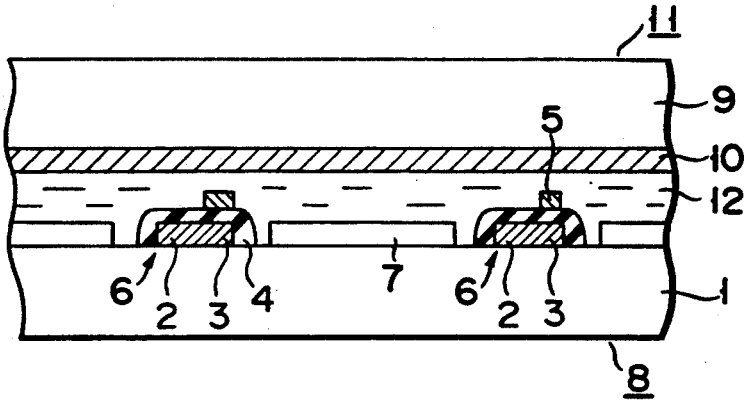

FIGS. 4 and 5 are views showing a liquid crystal display device according to an embodiment of the present invention, in which FIG. 4 is a plane view showing a matrix array substrate of this liquid crystal display device, and FIG. 5 is a sectional view of the liquid crystal display device taken along a line A—A' in FIG. 4.

A structure of the liquid crystal display device shown in FIGS. 4 and 5 will be described below in accordance with an order of manufacturing steps. Scanning electrodes 2 consisting of, e.g., Ta and lower electrodes 3 of switching element portions consisting of the same material are formed on a substrate 1 consisting of, e.g., glass. Insulating layers 4 of the switching element portions are formed on the surfaces of the scanning electrodes 2 and the lower electrodes 3 by anodizing. Subsequently, upper electrodes 5 constituting the switching element portions and consisting of, e.g., Cr are formed on the insulating layers 4 to form switching elements 6. Pixel electrodes 7 consisting of, e.g., ITO (Indium Tin Oxide) are formed on regions between the scanning electrodes 2 on the substrate 1 and electrically connected to the upper electrodes 5, thereby forming a matrix array substrate 8.

Display electrodes 10 consisting of, e.g., ITO are formed on a counter substrate 9 consisting of, e.g., glass in a direction perpendicular to the direction of the scanning electrodes 2, thereby preparing a counter substrate member 11. The matrix array substrate 8 and the counter substrate 11 are opposed to each other with a space of 5 to 20 μm therebetween, and a liquid crystal 12 is injected in this space. In this structure, each pixel is constituted by the switching element 6, the pixel electrode 7, the display electrode 10, and the liquid crystal 12.

Figure 6:
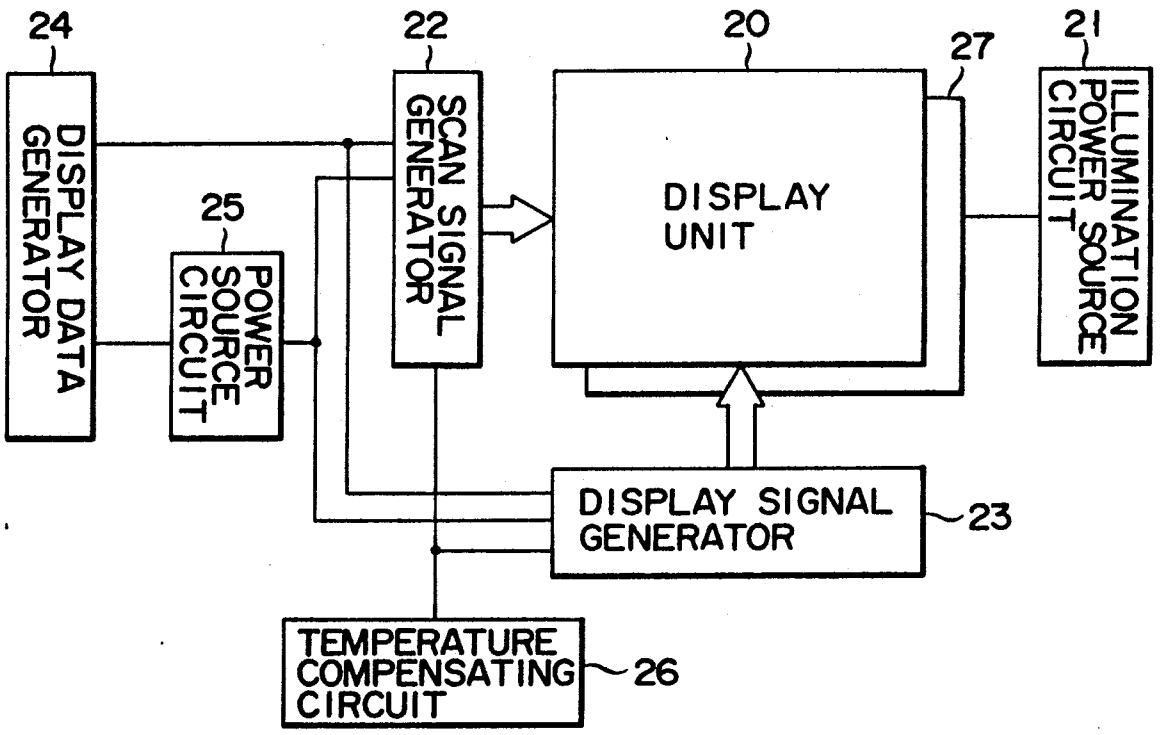
FIGS. 6, and 7A and 7B are a block diagram, and circuit diagrams, respectively, showing a drive power source unit for driving the liquid crystal display device shown in FIGS. 4 and 5.

The liquid crystal display device shown in FIG. 4 has pixels of 450×1,152 dots and is driven by a driving system shown in FIG. 6. That is, the rear surface of a display unit 20 of the liquid crystal display device is illuminated by an illuminator 27 which is energized by an illumination power source circuit 21. A scan signal generator 22 modulates a voltage signal from a power source circuit 25 using a data signal generated by a display data generator 24 and generates a scan signal. Similarly, a display signal generator 23 modulates the voltage signal from the power source circuit 25 using the data signal and generates a display signal. In each pixel of the display unit 20, the scan signal generated by the scan signal generator 22 is applied to the scanning electrodes 2, and the display signal generated by the display signal generator 23 is applied to the display electrodes 10. The pixels of the display unit 20 are driven by these signals. A temperature compensating circuit 26 is connected to the power source circuit 25 to maintain the bias voltage at an optimal voltage at which an afterimage is minimized. That is, although the bias voltage is determined on the basis of a threshold voltage Vth of the liquid crystal, this threshold voltage Vth changes in accordance with a temperature change. For example, when the environmental temperature rises to decrease the threshold voltage of the liquid crystal, in order to decrease the bias voltage, the power source circuit 25 optimally changes the bias voltage in accordance with a signal from the temperature compensating circuit 26 and applies this optimal power voltage to the scanning signal generator 22 and display signal generator 23. Thus, an optimal scanning signal is generated from the scanning signal generator 22 and is applied to the scanning electrodes 2 and an optimal display signal is generated from the display signal generator 23 and is applied to the display electrodes 23.

Figure 7A:
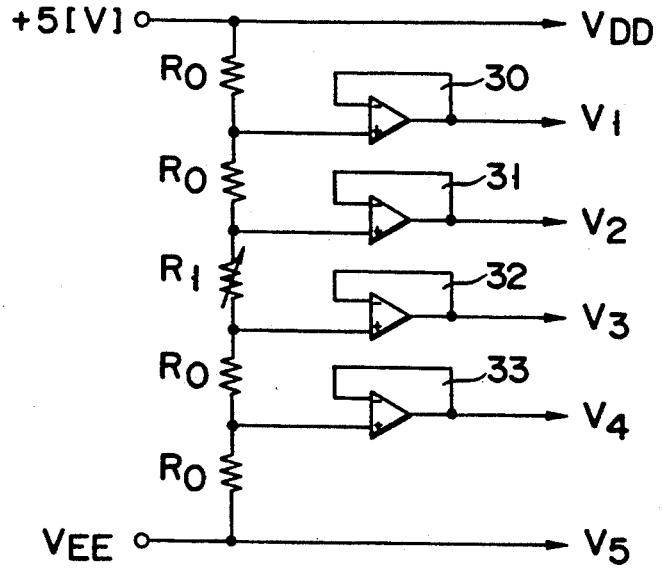
Figure 7B:
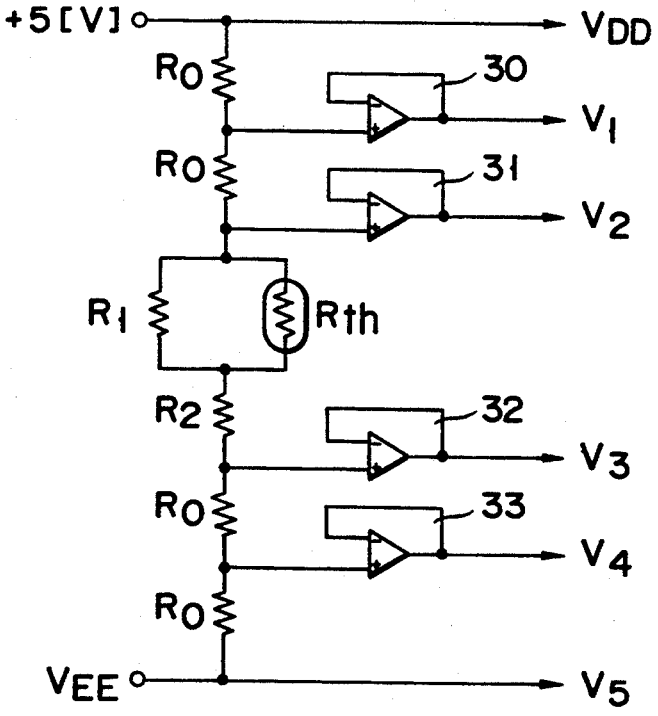

As has been described above, each liquid crystal pixel incorporates the switching element 6 as an MIM element having a nonlinear current-voltage characteristic which is asymmetrical between the positive and negative directions of voltage application. The liquid crystal 12 consists of a material having a threshold voltage Vth of 1.9 (V) and a saturation voltage Vsat of 3.3 (V) as electrooptical characteristics. The drive power source unit 25 of this liquid crystal display device is constituted by a circuit in which the bias voltage is set at 1 to 4 (V) at a duty ratio of 1/450 and which generates a waveform for time-division driving. More specifically, as shown in FIG. 7A, this power source circuit 25 is constituted by a variable resistor R1 connected in series with resistors R0, and amplifiers 30, 31, 32, and 33 connected to nodes between the resistor R1 and the resistors R0. Power voltages VDD and V1 to V5 can be manually changed by the variable resistor R1. Similarly, as shown in FIG. 7B, the power source circuit 25 including the temperature compensating circuit 26 is constituted by a parallel circuit including a resistor R1 connected in series with resistors R0 and a thermistor Rth, and amplifiers 30, 31, 32, and 33 connected to nodes between the resistor R1 and the resistors R0. Power voltages VDD and V1 to V5 are changed by the thermistor Rth having a resistance which changes in accordance with the temperature.

Figure 8A:
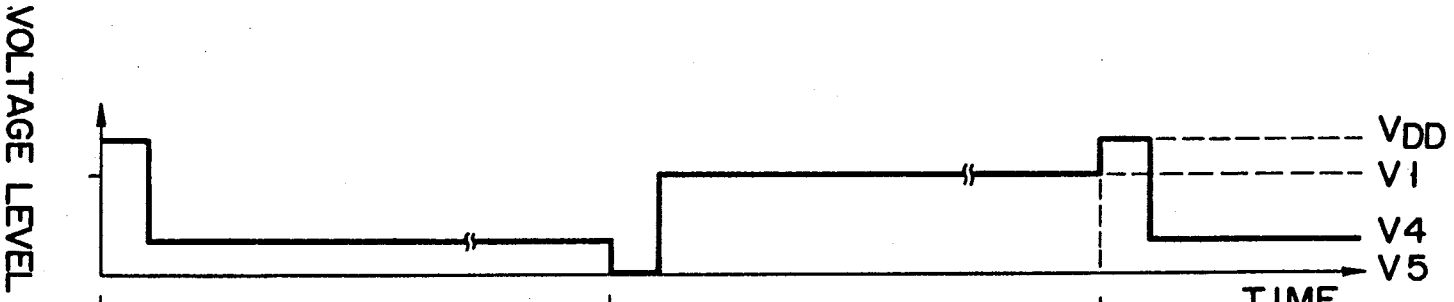
FIGS. 8A and 8B are waveforms of voltages applied to scanning electrodes and display electrodes, respectively.
Figure 8B:
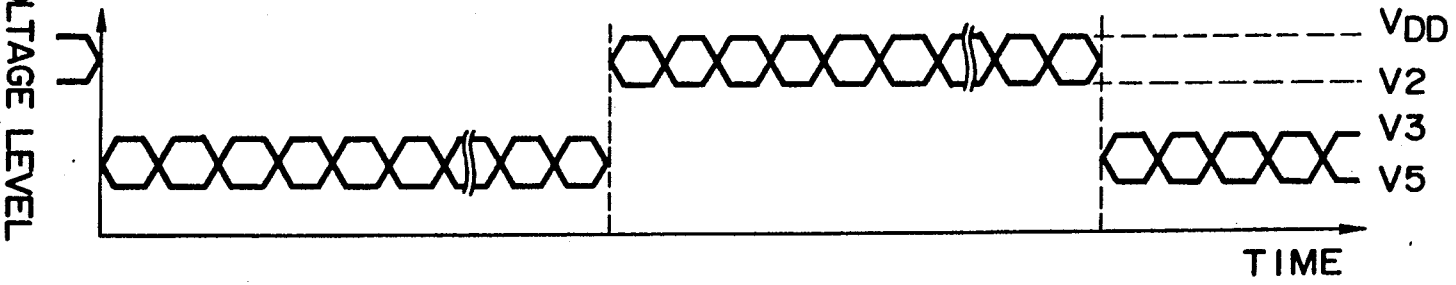

The power voltages VDD, V1, V4 and V5 are applied to the scanning signal generator 22 and the scanning signal as shown in FIG. 8A is output to the scanning electrodes 2 from the scanning signal generator 22. The power voltages VDD, V2, V3 and V5 are also applied to the display signal generator 23 and the display signal as shown in FIG. 8B is output to the display electrodes 10 from the display signal generator 23. In FIGS. 8A and 8B, the absolute value $|VDD-V5|$ corresponds to the voltage Vop which is applied to the pixel during the selecting period and the absolute value $|VDD-V2|$ corresponds to the bias voltage Vb.

Figure 9:
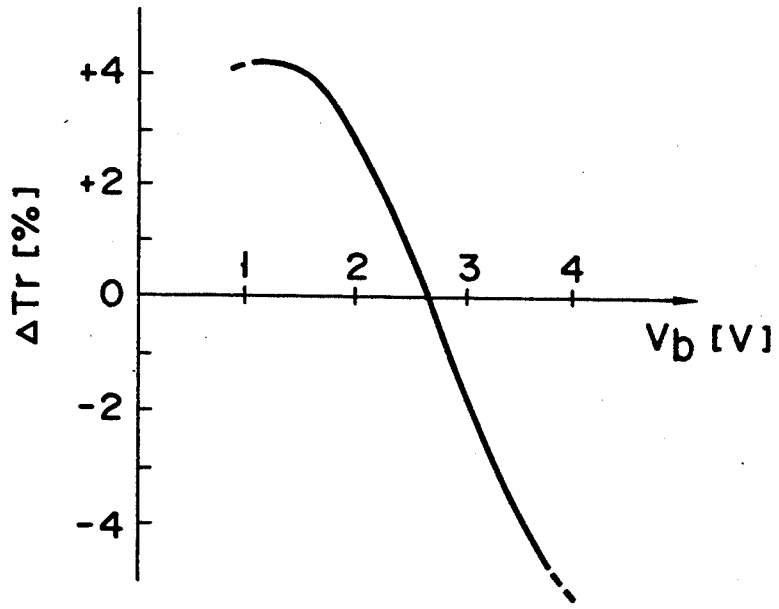
FIG. 9 is a graph showing a dependency of the size of an afterimage phenomenon on a voltage applied to pixels during a nonselect period in the liquid crystal display device shown in FIGS. 4 and 5.

FIG. 9 is a graph showing a dependency of the size of an afterimage phenomenon on a voltage applied to pixels during the nonselect period in the liquid crystal display device shown in FIGS. 4 and 5. Referring to FIG. 9, the ordinate represents a difference ΔTr between a transmittance obtained when, assuming that the transmittance transmittance of an OFF state (light transmission state) is 100%, an ON state (transmittance=50%) is continuously set after it is continued for five minutes and that obtained when the ON state is set after the OFF state is continued for five minutes, and the abscissa represents a voltage Vb. As shown in FIG. 9, when Vb falls within the range of 2.2 to 3.1 (V), i.e., the range of $V'/2-0.4$ and $V'/2+0.5$, $\Delta Tr$ is as small as 2% or less. More preferably, Vb falls within the range of 2.4 to 2.9 (V) in which $\Delta Tr$ is 1% or less. In this case, no afterimage was found in a normal display state (in which the contrast ratio was maximized). On the other hand, when Vb was lower than 2.2 (V) and higher than 3.1 (V), respectively, a black afterimage and a white afterimage were visually confirmed and $\Delta Tr$ was as large as 2% or more.

A bias voltage at which $|\Delta Tr|$ is minimized is shifted to the low-voltage side when, for example, Vth of the liquid crystal is decreased by a temperature rise. However, in the device having the drive power source unit as shown in FIG. 8B in which the bias voltage is kept at an optimal value by the thermistor, no afterimage phenomenon was found even when the ambient temperature changed, and a high-speed response time of 45 msec and a high contrast ratio of Ca. 50 could be obtained. That is, it was confirmed that the device provided a good display.

According to the present invention as has been described above, a voltage applied to each MIM element during the nonselect period is set at an optimal value at which no DC voltage is generated even when a current-voltage characteristic of the MIM element is asymmetrical in the positive and negative directions. Therefore, a good display free from an afterimage can be obtained.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A method of driving a liquid crystal display device, said liquid crystal display device comprising:

switching elements each having a nonlinear current-voltage characteristic which is asymmetrical between positive and negative directions of voltage application;

a plurality of pixels each incorporating said switching element; and a liquid crystal having a threshold voltage Vth (V) and a saturation voltage Vsat (V) as electrooptical characteristics, wherein said liquid crystal display device is time-divisionally driven by a voltage waveform constituted by a select period in which a signal voltage is written in predetermined pixels and a nonselect period in which the written signal voltage is held, and an absolute value Vb (V) of the voltage applied to said pixels during the nonselect period satisfies a relation of:

$$V'/2-0.4 \leqq Vb \leqq V'/2+0.5$$

(where $V'=Vth+Vsat$).

2. A method according to claim 1, wherein the absolute value Vb (V) of the voltage is set within a range of 2.2 to 3.1 volts.

3. A method according to claim 1, wherein the absolute value Vb (V) is set within a range of 2.4 to 2.9 volts.

4. A liquid crystal display device comprising:

switching elements each having a nonlinear current-voltage characteristic which is asymmetrical between positive and negative directions of voltage application;

a plurality of pixel electrodes connected to said switching elements;

a plurality of counter electrodes arranged to oppose said pixel electrodes;

a liquid crystal layer arranged between said pixel electrodes and said counter electrodes and having a threshold voltage Vth (V) and a saturation voltage Vsat (V) as electrooptical characteristics; and means for generating a signal voltage applied between predetermined counter electrodes and pixel electrodes, thereby time-divisionally driving said counter electrodes and said pixel electrodes, wherein a voltage having a voltage waveform constituted by a select period in which the signal voltage is applied and a nonselect period in which the signal voltage is held is generated between said electrodes, and an absolute value Vb (V) of the voltage applied between said electrodes during the nonselect period satisfies a relation of:

$$V'/2-0.4 \leqq Vb \leqq V'/2+0.5$$

(where $V'=Vth+Vsat$).

5. An apparatus according to claim 4, wherein the absolute value Vb (V) of the voltage is set within a range of 2.2 to 3.1 volts.

6. An apparatus according to claim 4, wherein the absolute value Vb (V) is set within a range of 2.4 to 2.9 volts.

7. An apparatus according to claim 4, wherein said pixel electrodes are arranged in a matrix manner.

8. An apparatus according to claim 4, wherein each switching element is of a metal-insulator-metal type and includes a first metal layer, an insulating layer formed on said first metal layer, and a second metal layer formed on said insulating layer and electrically connected to said pixel electrodes.

* * * * *